US010239344B2

(12) United States Patent
Caffey

(10) Patent No.: US 10,239,344 B2
(45) Date of Patent: Mar. 26, 2019

(54) WRITING UTENSIL SYSTEM

(71) Applicant: Dee Caffey, Akron, OH (US)

(72) Inventor: Dee Caffey, Akron, OH (US)

( * ) Notice: Subject to any disclaimer, the term of this patent is extended or adjusted under 35 U.S.C. 154(b) by 92 days.

(21) Appl. No.: 15/398,169

(22) Filed: Jan. 4, 2017

(65) Prior Publication Data

US 2018/0186174 A1 Jul. 5, 2018

(51) Int. Cl.
*A46B 5/02* (2006.01)
*B43K 23/06* (2006.01)

(52) U.S. Cl.
CPC ..... *B43K 23/06* (2013.01)

(58) Field of Classification Search
CPC ..... B43K 23/06; B43K 23/016; B43K 23/10; B43K 23/12
USPC ..... 401/6–8, 34, 48
See application file for complete search history.

(56) References Cited

U.S. PATENT DOCUMENTS 151,292 A 5/1874 Jolly
515,075 A * 2/1894 Deats ..... B43L 9/02 33/27.02
1,977,527 A 10/1934 Pohl
2,189,715 A 2/1940 Hoiseth
2,370,414 A * 2/1945 Ostrander ..... A45D 40/264 132/318
2,510,302 A 6/1950 White
3,596,964 A * 8/1971 Zazzara ..... B43K 23/012 224/217
5,263,259 A 11/1993 Cimador
5,318,372 A 6/1994 Besthorne
5,542,588 A 8/1996 Sison
6,290,413 B1 * 9/2001 Wang ..... B43K 21/006 401/30
6,425,703 B1 7/2002 McDonnell et al.
6,802,665 B2 10/2004 Brown
7,270,289 B2 9/2007 Kish
7,490,410 B2 * 2/2009 Ordaz ..... B43K 19/02 33/18.2

* cited by examiner

*Primary Examiner* — Jennifer C Chiang

(57) ABSTRACT

A writing utensil system for facilitating a pair of writing utensils to be simultaneously used includes a pair of writing utensils. Each of the writing utensils may be manipulated thereby facilitating each of the writing utensils to write. A swivel unit is provided and each of the writing utensils is removably coupled thereto. The swivel unit facilitates each of the writing utensils to be simultaneously available for writing.

7 Claims, 6 Drawing Sheets

WRITING UTENSIL SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to writing utensil devices and more particularly pertains to a new writing utensil device for facilitating a pair of writing utensils to be simultaneously used.

BRIEF SUMMARY OF THE INVENTION

An embodiment of the disclosure meets the needs presented above by generally comprising a pair of writing utensils. Each of the writing utensils may be manipulated thereby facilitating each of the writing utensils to write. A swivel unit is provided and each of the writing utensils is removably coupled thereto. The swivel unit facilitates each of the writing utensils to be simultaneously available for writing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
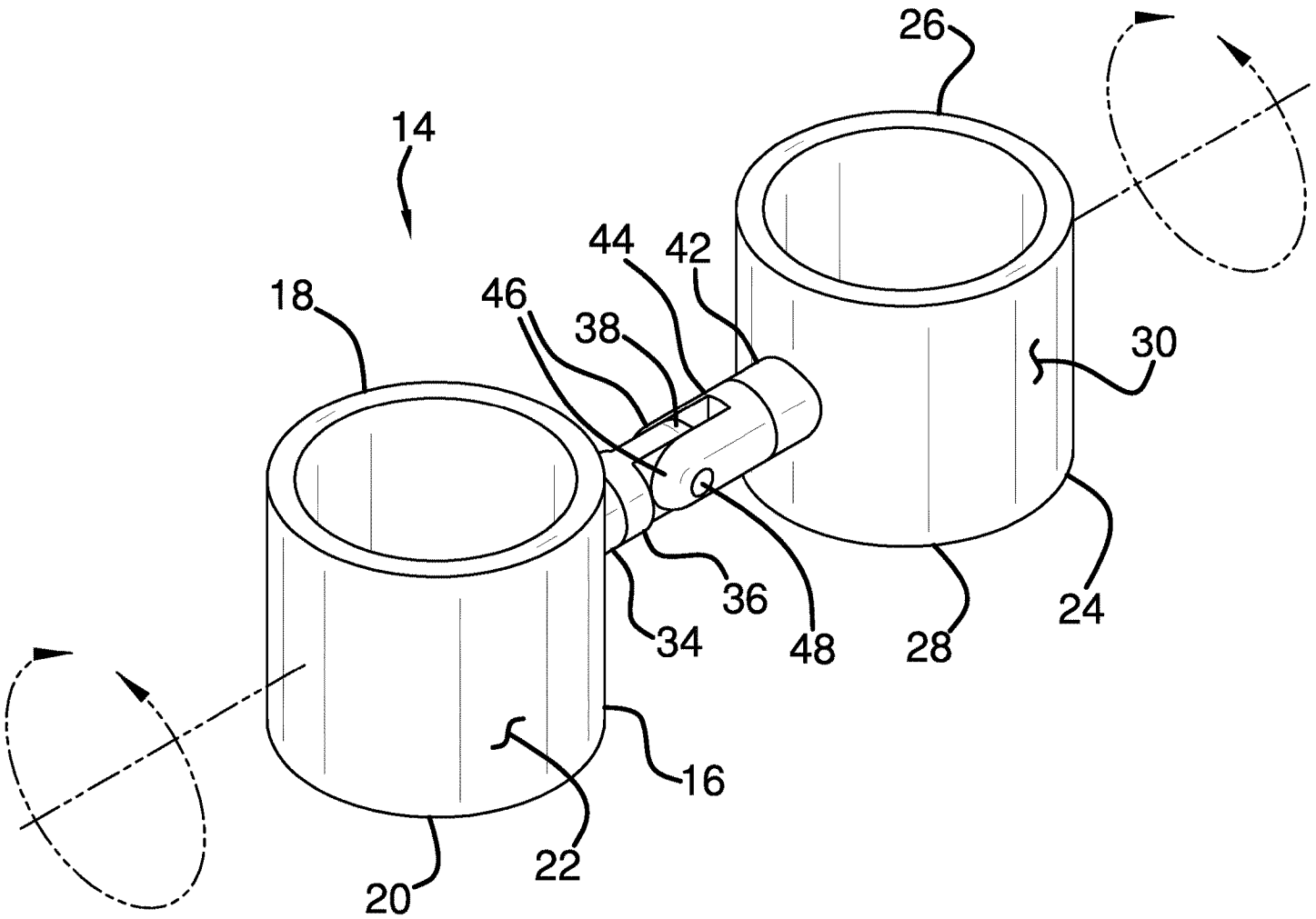
FIG. 1 is a perspective view of a swivel unit of a writing utensil system according to an embodiment of the disclosure.
Figure 2:
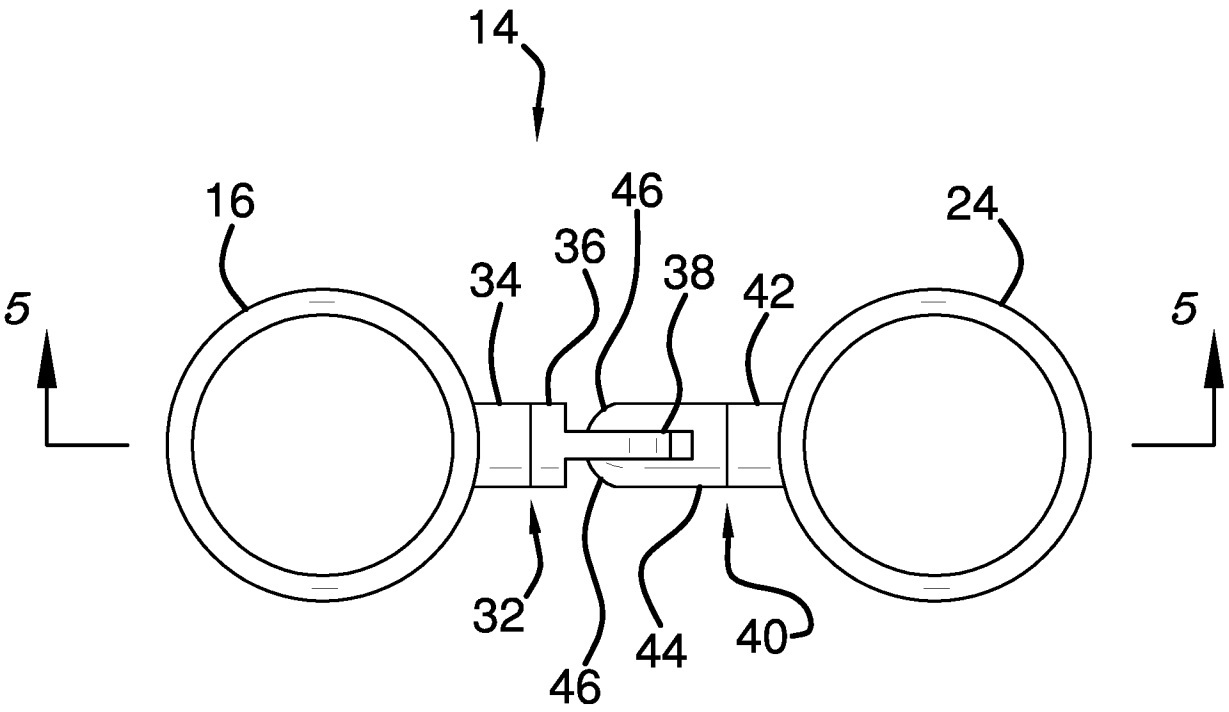
FIG. 2 is a bottom view of swivel unit of an embodiment of the disclosure.
Figure 3:
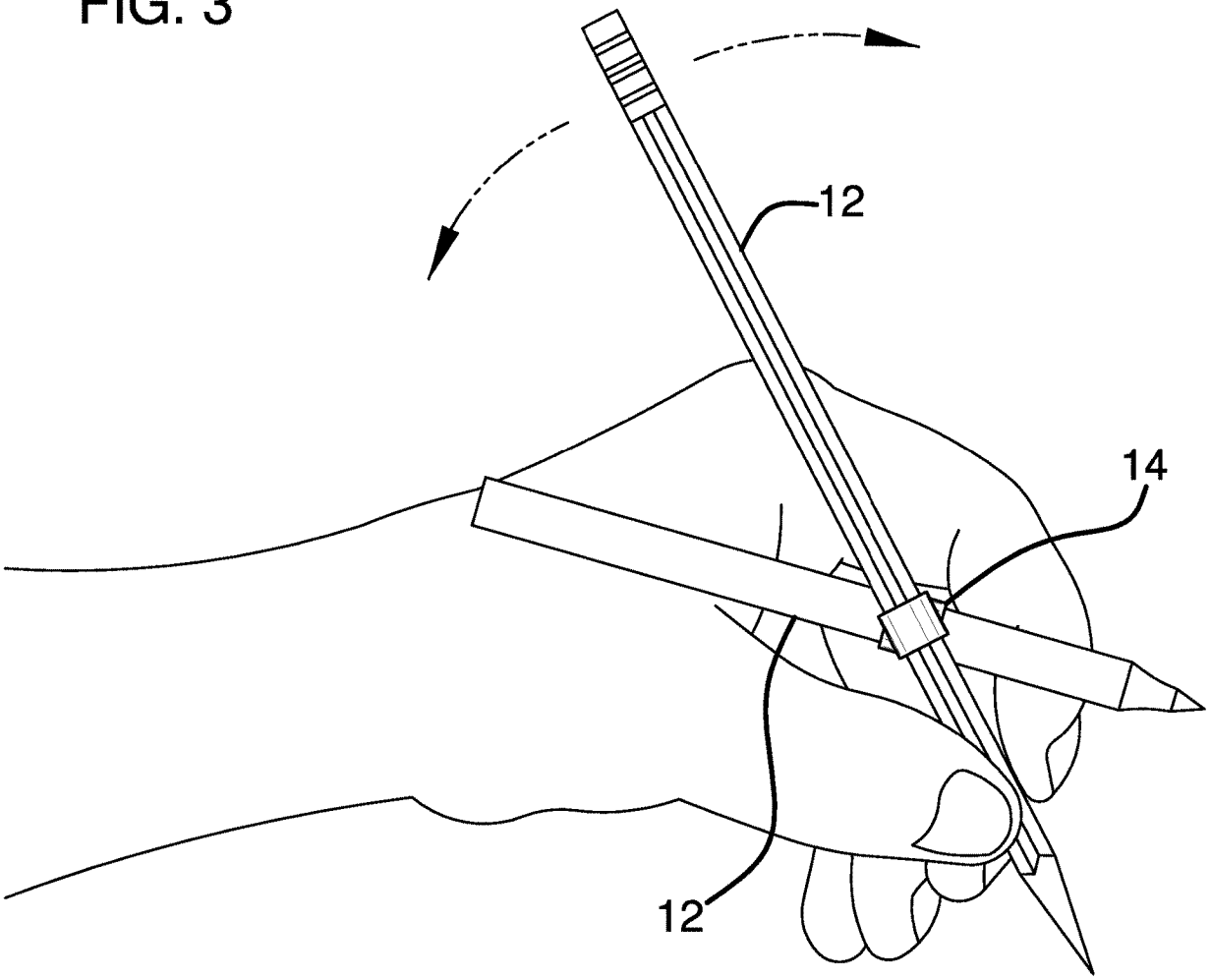
FIG. 3 is a perspective in-use view of an embodiment of the disclosure.
Figure 4:
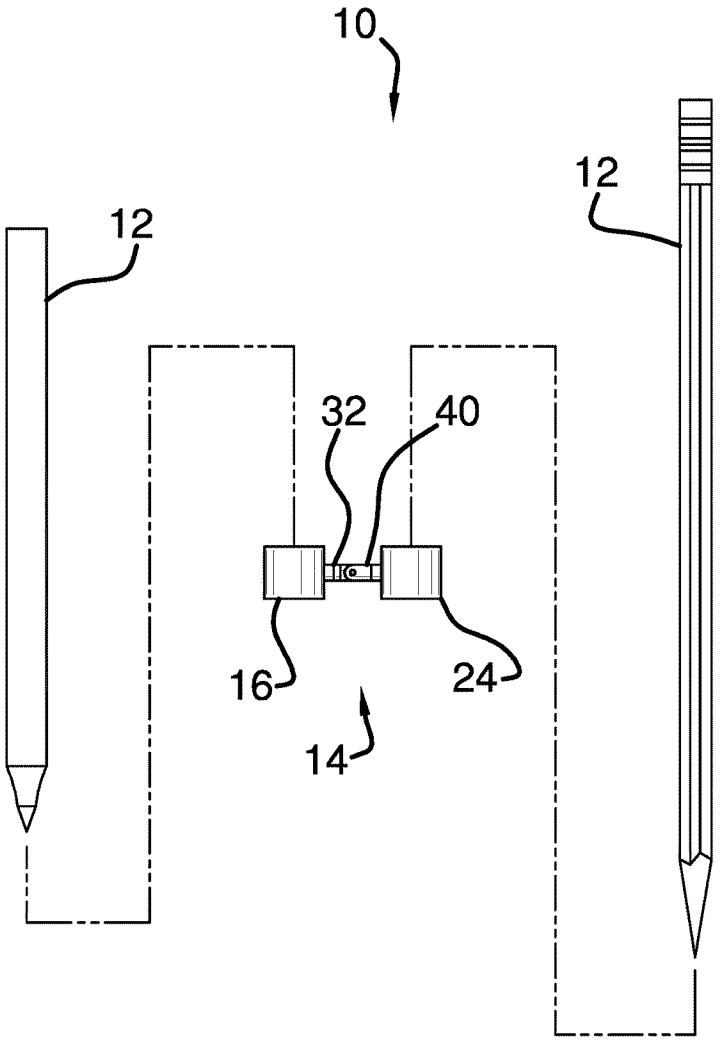
FIG. 4 is a front view exploded view of an embodiment of the disclosure.
Figure 5:
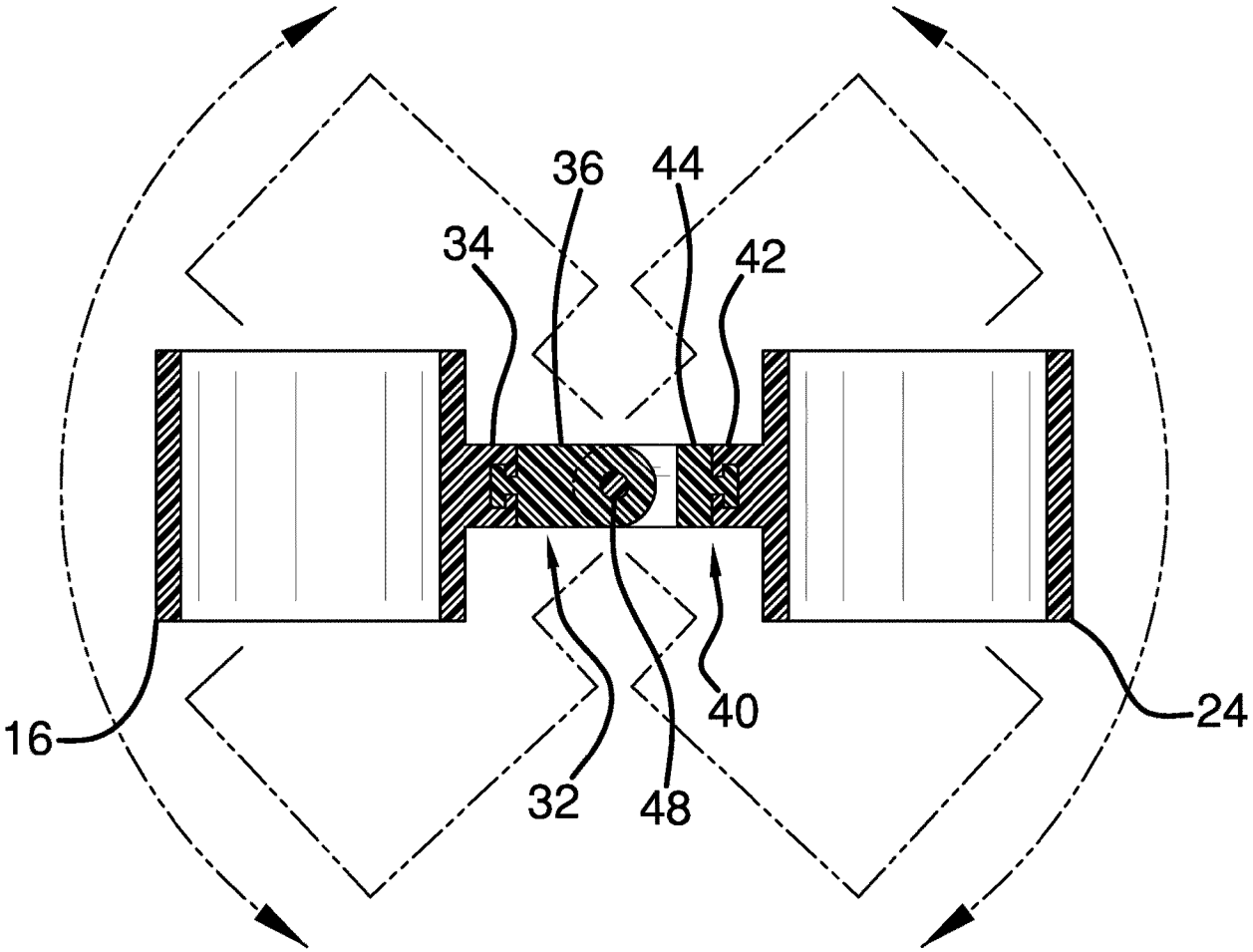
FIG. 5 is a cross sectional view taken along line 5-5 of FIG. 2 of an embodiment of the disclosure.
Figure 6:
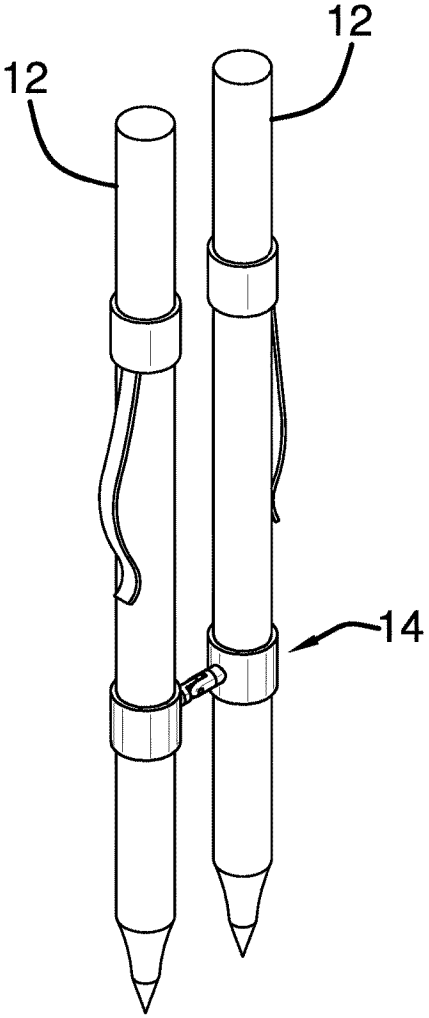
FIG. 6 is a top perspective view of an embodiment of the disclosure.

With reference now to the drawings, and in particular to FIGS. 1 through 6 thereof, a new writing utensil device embodying the principles and concepts of an embodiment of the disclosure and generally designated by the reference numeral 10 will be described.

As best illustrated in FIGS. 1 through 6, the writing utensil system 10 generally comprises a pair of writing utensils 12. Each of the writing utensils 12 may be manipulated thereby facilitating each of the writing utensils 12 to write. Each of the writing utensils 12 may be an ink pen, a pencil or any combination thereof. A pair of the ink pens may be used and each of the ink pens may have a unique color with respect to each other.

A swivel unit 14 is provided and each of the writing utensils 12 is removably coupled thereto. In this way the swivel unit 14 facilitates each of the writing utensils 12 to be simultaneously available for writing. The swivel unit 14 comprises a first sleeve 16 that has a first end 18, a second end 20 and an outer surface 22 extending therebetween. The first sleeve 16 insertably receives a selected one of the writing utensils 12. The swivel unit 14 further includes a second sleeve 24 that has a primary end 26, a secondary end 28 and an exterior surface 30 extending therebetween. The second sleeve 24 insertably receives a selected one of the writing utensils 12.

A first coupler 32 is coupled to and extends away from the outer surface 22 of the first sleeve 16. The first coupler 32 has a first half 34 that is rotatably coupled to a second half 36. The second half 36 is selectively rotated about a longitudinal axis extending through the first half 34 and the second half 36. The first half 34 is positioned on the first sleeve 16 and the second half 36 includes a first finger 38 extending away from the second half 36. The first finger 38 is collinear with the longitudinal axis. The first half 34 may be rotatably coupled to the second half 36 via a tab that engages a slot or any other mechanical means of rotatable coupling.

A second coupler 40 is coupled to and extends away from the exterior surface 30 of the second sleeve 24. The second coupler 40 has a primary half 42 that is rotatably coupled to a secondary half 44. The secondary half 44 is selectively rotated about a longitudinal axis extending through the primary half 42 and the secondary half 44. The primary half 42 is positioned on the second sleeve 24.

The secondary half 44 has a pair of second fingers 46. Each of the second fingers 46 extends away from the secondary half 44 and the second fingers 46 are spaced apart from each other. Each of the second fingers 46 is collinear with the longitudinal axis extending through the second coupler 40 and the first finger 38 is positioned between each of the second fingers 46. The primary half 42 may be rotatably coupled to the secondary half 44 via a tab that engages a slot or any other mechanical means of rotatable coupling.

A pin 48 is provided and the pin 48 extends through each of the second fingers 46 and engages the first finger 38. In this way the first finger 38 is rotatably coupled to each of the second fingers 46 such that the first coupler 32 is positionable at a selected angle with respect to the second coupler 40.

In use, each of the writing utensils 12 is inserted into an associated one of the first sleeve 16 and the second sleeve 24. The writing utensil 12 corresponding to the first sleeve 16 is gripped for writing and the second sleeve 24 is rotated. In this way the writing utensil 12 corresponding to the second sleeve 24 does not inhibit writing with the writing utensil 12 corresponding to the first sleeve 16. Moreover, the second sleeve 24 is positioned at a selected angle with respect to the first sleeve 16 to enhance comfort with respect to the writing utensil 12 corresponding to the second sleeve 24.

The writing utensil 12 corresponding to the second sleeve 24 is gripped for writing and the first sleeve 16 is rotated. In this way the writing utensil 12 corresponding to the first sleeve 16 does not inhibit writing with the writing utensil 12 corresponding to the second sleeve 24. Additionally, the first sleeve 16 is positioned at a selected angle with respect to the second sleeve 24 to enhance comfort with respect to the writing utensil 12 corresponding to the first sleeve 16. The swivel unit 14 facilitates the pair of writing utensils 12 to be available for writing without having to locate either of the writing utensils 12 on a desk or the like.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A writing utensil system comprising:

a pair of writing utensils, each of said writing utensils being configured to be manipulated thereby facilitating each of said writing utensils to write; and a swivel unit having each of said writing utensils being removably coupled thereto, said swivel unit facilitating each of said writing utensils to be simultaneously available for writing, wherein said swivel unit comprises a first sleeve having a first end, a second end and an outer surface extending therebetween, said first sleeve insertably receiving a selected one of said writing utensils, and a first coupler being coupled to and extending away from said outer surface of said first sleeve, said first coupler having a first half being rotatably coupled to a second half such that said second half is selectively rotated about a longitudinal axis extending through said first half and said second half, said first half being positioned on said first sleeve.

2. The system according to claim 1, wherein said swivel unit comprises a second sleeve having a primary end, a secondary end and an exterior surface extending therebetween, said second sleeve insertably receiving a selected one of said writing utensils.

3. The system according to claim 1, wherein said second half includes a first finger extending away from said second half, said first finger being collinear with said longitudinal axis.

4. A writing utensil system comprising:

a pair of writing utensils, each of said writing utensils being configured to be manipulated thereby facilitating each of said writing utensils to write; and a swivel unit having each of said writing utensils being removably coupled thereto, said swivel unit facilitating each of said writing utensils to be simultaneously available for writing, wherein said swivel unit comprises a first sleeve insertably receiving a selected one of said writing utensils, a first coupler being coupled to said first sleeve, a second sleeve having a primary end, a secondary end and an exterior surface extending therebetween, said second sleeve insertably receiving a selected one of said writing utensils, and a second coupler being coupled to and extending away from said exterior surface of said second sleeve, said second coupler having a primary half being rotatably coupled to a secondary half such that said secondary half is selectively rotated about a longitudinal axis extending through said primary half and said secondary half, said primary half being positioned on said second sleeve.

5. The system according to claim 4, wherein:

said swivel unit includes a first coupler, said first coupler having a first finger; and said secondary half has a pair of second fingers, each of said second fingers extending away from said secondary half, said second fingers being spaced apart from each other, each of said second fingers being collinear with said longitudinal axis extending through said second coupler, said first finger being positioned between each of said second fingers.

6. The system according to claim 5, further comprising a pin extending through each of said second fingers and engaging said first finger, said first finger being rotatably coupled to each of said second fingers such that said first coupler is positionable at a selected angle with respect to said second coupler.

7. A writing utensil system comprising:

a pair of writing utensils, each of said writing utensils being configured to be manipulated thereby facilitating each of said writing utensils to write; and a swivel unit having each of said writing utensils being removably coupled thereto, said swivel unit facilitating each of said writing utensils to be simultaneously available for writing, said swivel unit comprising:

a first sleeve having a first end, a second end and an outer surface extending therebetween, said first sleeve insertably receiving a selected one of said writing utensils, a second sleeve having a primary end, a secondary end and an exterior surface extending therebetween, said second sleeve insertably receiving a selected one of said writing utensils, a first coupler being coupled to and extending away from said outer surface of said first sleeve, said first coupler having a first half being rotatably coupled to a second half such that said second half is selectively rotated about a longitudinal axis extending through said first half and said second half, said first half being positioned on said first sleeve, said second half including a first finger extending away from said second half, said first finger being collinear with said longitudinal axis, a second coupler being coupled to and extending away from said exterior surface of said second sleeve, said second coupler having a primary half being rotatably coupled to a secondary half such that said secondary half is selectively rotated about a longitudinal axis extending through said primary half and said secondary half, said primary half being positioned on said second sleeve, said secondary half having a pair of second fingers, each of said second fingers extending away from said secondary half, said second fingers being spaced apart from each other, each of said second fingers being collinear with said longitudinal axis extending through said second coupler, said first finger being positioned between each of said second fingers, and a pin extending through each of said second fingers and engaging said first finger, said first finger being rotatably coupled to each of said second fingers such that said first coupler is positionable at a selected angle with respect to said second coupler.

* * * * *